US008783988B2

(12) United States Patent
Sanchez

(10) Patent No.: US 8,783,988 B2
(45) Date of Patent: Jul. 22, 2014

(54) ASSEMBLY COMPRISING A PRODUCT-PACKAGING SYSTEM WITH SEALED CLOSURE

(75) Inventor: Marcel Sanchez, Aulnay-sous-Bois (FR)

(73) Assignee: L'Oreal, Paris (FR)

( * ) Notice: Subject to any disclaimer, the term of this patent is extended or adjusted under 35 U.S.C. 154(b) by 372 days.

(21) Appl. No.: 13/257,060

(22) PCT Filed: Mar. 16, 2010

(86) PCT No.: PCT/EP2010/053384

§ 371 (c)(1),
(2), (4) Date: Nov. 2, 2011

(87) PCT Pub. No.: WO2010/106065

PCT Pub. Date: Sep. 23, 2010

(65) Prior Publication Data

US 2012/0039659 A1 Feb. 16, 2012

(30) Foreign Application Priority Data

Mar. 16, 2009 (WO) ..... PCT/FR2009/050425

(51) Int. Cl.
*A46B 11/00* (2006.01)

(52) U.S. Cl.
USPC ..... 401/126; 401/127; 401/109

(58) Field of Classification Search
USPC ..... 401/126, 127, 109, 111, 113, 114
See application file for complete search history.

(56) References Cited

U.S. PATENT DOCUMENTS 4,917,520 A 4/1990 Reid
7,429,140 B2 * 9/2008 Demellier ..... 401/98
7,841,794 B2 * 11/2010 Salciarini et al. ..... 401/98
7,874,753 B2 * 1/2011 Domy et al. ..... 401/99
8,287,199 B2 * 10/2012 Salciarini et al. ..... 401/109
8,287,201 B2 * 10/2012 Salciarini et al. ..... 401/126
8,292,529 B2 * 10/2012 Francavilla ..... 401/101
2006/0285911 A1 12/2006 Demellier
2009/0261007 A1 10/2009 Sanchez

FOREIGN PATENT DOCUMENTS

DE 44 34 793 4/1996
EP 1 086 904 3/2001
GB 2410682 A * 8/2005

OTHER PUBLICATIONS

International Search Report Issued Jun. 22, 2010 in PCT/EP10/053384 filed Mar. 16, 2010.

* cited by examiner

*Primary Examiner* — David Walczak
*Assistant Examiner* — Jennifer C Chiang
(74) *Attorney, Agent, or Firm* — Oblon, Spivak, McClelland, Maier & Neustadt, L.L.P.

(57) ABSTRACT

The assembly comprises a system for the packaging and application of a product and a device for protecting said system. The system comprises a receptacle for storing the product, a product applicator, and a member for closing the receptacle bearing the applicator. The protective device comprises a cap mounted on the system and at least one means for releasing the system. The releasing means comprises a means for holding the system relative to the device and a means for actuating the holding means in order to render the holding means inactive and at least partly separate the system and the protective device. The assembly also comprises return means capable of maintaining a sealed contact between the closing member and the storage receptacle in an active position of the holding means.

17 Claims, 12 Drawing Sheets

ASSEMBLY COMPRISING A PRODUCT-PACKAGING SYSTEM WITH SEALED CLOSURE

Figure 1:
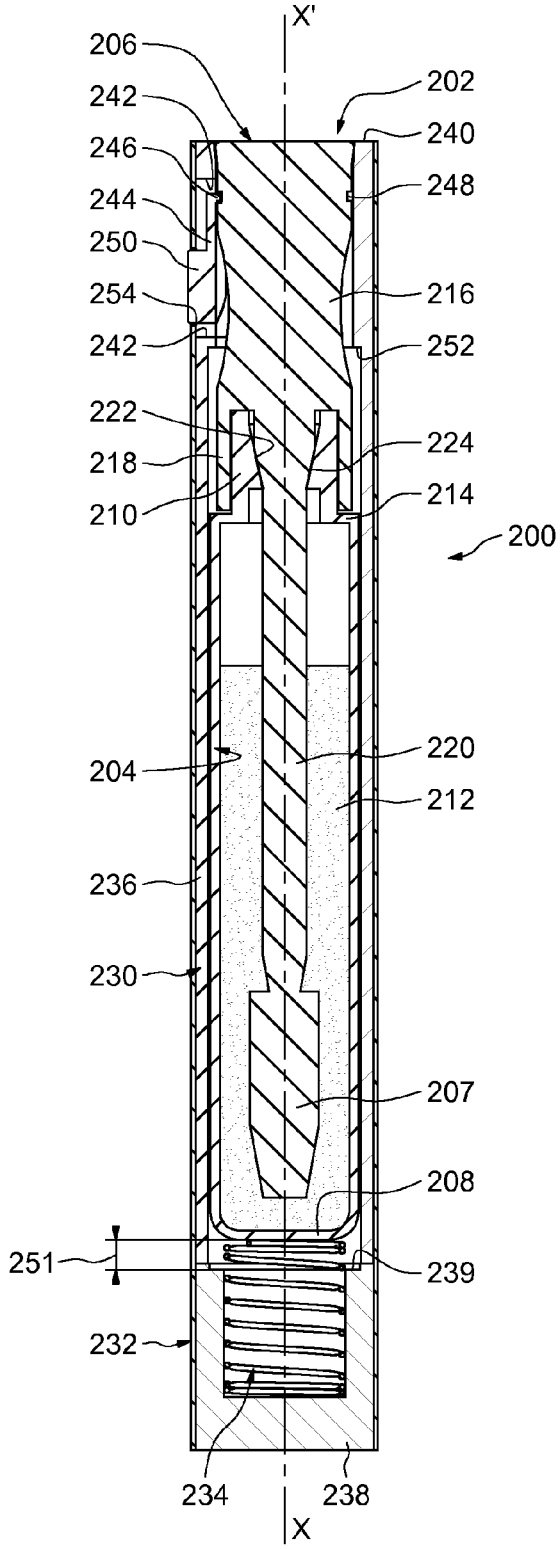

The present invention relates to the field of protective devices for systems for packaging and applying product.

One of the worthwhile applications of the invention relates to the protection of a system for packaging and applying a cosmetic product and the maintenance of a good seal of the system. "Cosmetic product" means a product as defined in Council Directive 93/35/EEC of Jun. 14, 1993.

But the invention relates in general to a device provided to be mounted on a product-packaging system so as to cover it at least partly and to promote the conservation of a good seal of the system.

In the cosmetics field, document US-A1-2006/0285911 discloses a cap for closure of a system for packaging a lipstick provided with a sleeve inside which said system is intended to be housed and on which ramps are made interacting with a lug arranged on a ring surrounding the sleeve. An elastic spring is also provided between the bottom of the cap and the packaging system in order to make it easier to extract from the cap.

The closure cap from this document has in particular the major drawback of comprising a relatively high number of parts in order to obtain protection of the packaging system and its extraction from the cap.

Also known, through document FR-A1-2 831 032, is a receptacle for storing a cosmetic product provided with a closing member which closes an open end of the receptacle in order to keep the product away from the air. The product is applied by means of an applicator mounted on the end of a stem supported by the closing member so that, when the receptacle is closed, the applicator is pushed into the receptacle in contact with the product. A wringing member mounted in the neck of the receptacle makes it possible to provide the seal between the latter and the closing member.

In order to ensure a seal between a cosmetic product storage receptacle and the associated closing member, patent application WO-A1-02/052981 proposes an inner boss on the closing member designed to apply tight pressure to the outer surface of the product storage receptacle.

These solutions do not make it possible to maintain a good seal for the stored product because the closing member can be moved accidentally relative to the storage receptacle, and even become separated from the latter. This may allow air or polluting agents to enter the receptacle containing the product and cause a modification of its physico-chemical properties.

The object of the present invention is therefore to remedy these drawbacks.

More particularly, the object of the present invention is to provide an assembly comprising a system for the packaging and application of a product and a device for protecting the system making it possible to obtain and conserve a good seal, particularly against the solvents that can be used in the product and/or the ambient air that is capable of coming into contact with the product.

A further object of the present invention is to provide an assembly that is easy to manufacture, economical and able to be carried easily without risk of accidental detachment of the elements forming it.

A further object of the invention is to provide an assembly that can be easily handled and allow a rapid separation of the device and of the packaging and application system.

A further object of the present invention is to provide an assembly for which handling is improved while reducing the risk of spontaneous release of the packaging and application system.

In one embodiment, the assembly comprises a system for packaging and applying a product, particularly a cosmetic product, and a device for protecting the system. The system comprises a receptacle for storing the product, a product applicator capable of being inserted into the receptacle in order to be loaded with product to be applied, and a member for closing the receptacle bearing the applicator. The protective device comprises a cap mounted on the system so as to at least partly cover it and at least one means for releasing the system, the releasing means comprising a means for holding the system relative to the device and a means for actuating the holding means in order to render the holding means inactive and at least partly separate the system and the protective device.

The assembly also comprises return means capable of applying an axial force to the packaging and application system in order to maintain a sealed contact or pressure between the closing member and the storage receptacle in the active position of the holding means.

The closing member and the storage receptacle may be in contact one another directly or by interposition of an intermediate element, for example a wringing member fitted into the neck of the receptacle.

The closing member supporting the applicator is distinct from the cap of the protective device. The means for releasing the system is distinct from the cap of the protective device. The cap of the protective device may advantageously be provided to delimit a housing designed to at least partly receive only the product-packaging and -application system and not the cosmetic product.

A neck of the storage receptacle is held axially pressing against the closing member by the force applied by the return means in the active position of the holding means.

Preferably, the closing member comprises a stem bearing the applicator, the stem comprising a frustoconical surface sealingly engaged in the bore of a neck of the storage receptacle. The closing member may also comprise a skirt radially surrounding a neck of the storage receptacle and coming into contact against the latter.

In one embodiment, the cap comprises internally a shoulder forming an abutment for the storage receptacle so as to hold said receptacle inside the cap, during a pressure from the actuation means, only the closing member protruding axially relative to the cap under the effect of the return means.

In one embodiment, the holding means comprises snap-fitting means interacting directly with the closing member. The snap-fitting means may comprise at least one hook interacting with a groove created on the closing member. This groove may have any other appropriate shape, particularly a cross section with a linear or curved profile. The groove may in particular have a circular cross section relative to a lengthwise axis of the device. The groove is preferably annular. This avoids the provision of an indexation means between the cap and the closing member. These snap-fitting means could also comprise a plurality of recesses radially and/or axially spaced from one another.

Advantageously, the return means are placed axially between a bottom of the receptacle and a bottom of the protective device.

In one embodiment, the holding means is provided on an inner face of the releasing means, the actuation means being provided on an outer face of the releasing means opposite to the inner face.

The holding means and the actuation means may thus respectively define a holding surface and an actuation surface respectively provided on an inner face and an outer face, opposite to said inner face, of the releasing means. This holding means and this actuation means may therefore extend on either side of one and the same wall, that is to say of a common wall. Considering a lengthwise axis of the releasing means and/or of the cap, these means may be provided at a distinct axial height relative to one another. As a variant, or in addition, these means may be provided to be radially offset relative to one another.

Advantageously, the holding means is produced in a single piece with the actuation means.

The releasing means may be secured to the cap. Therefore, this releasing means may be fixedly anchored to this cap. Nevertheless, this releasing means may be able to be moved angularly relative to the cap. To do this, the means may be attached to the cap for example by one or more bridges of material made in a single piece with the cap or by means of spindles fitted to the cap, particularly rotation or pivot spindles.

Considering a lengthwise axis of the cap, the releasing means may extend to an intermediate axial height of the cap. In other words, this releasing means may extend to a distance from a bottom end surface of the cap and to a distance from a top end surface of said cap.

Preferably, the releasing means comprises a tipping system. More precisely, this system comprises at least one rotation or pivot spindle. This spindle may be situated between the holding means and the actuation means, said means being situated axially on either side of said spindle. In other words, considering a lengthwise axis of the cap or of the releasing means, at least one rotation spindle may extend to an intermediate axial height between the holding means and the actuation means.

In one embodiment, the protective device comprises a covering case mounted around the cap. The covering case may be fitted to the cap in order to at least partially cover the releasing means.

The covering case may partially, or even totally, cover the releasing means and in particular the outer face of the releasing means. More precisely, these covering means may engage with at least a portion of the releasing means and also if necessary with at least one portion of the cap.

The actuation means may comprise a lug extending at least partly into an opening made on the covering case so as to be accessible from the outside. The lug may be dimensioned so as to at least be flush with the outer surface of the covering case.

The covering case may be made of a material distinct from that of the body, for example more flexible. The covering case may be made of thermoplastic or of elastomer. The body may, for its part, be made of thermoplastic, particularly polyolefin, or of metal.

In one embodiment, the device comprises a single releasing means. As a variant, the device comprises two diametrically opposed releasing means.

In one embodiment, the packaging system comprises a wringing member mounted in a sealed manner in a neck of the storage receptacle. The wringing member may comprise axial holding means in the neck of the storage receptacle.

In one embodiment, the wringing member comprises means extending towards the inside and coming radially into sealed contact against the closing member. The contact between the means and the closing member is advantageously maintained by the force applied by the return means in the active position of the holding means. The closing member may comprise a closing cap, a stem holder mounted at least partly inside the closing cap and a stem supported by said stem holder and supporting the applicator.

Figure 2:
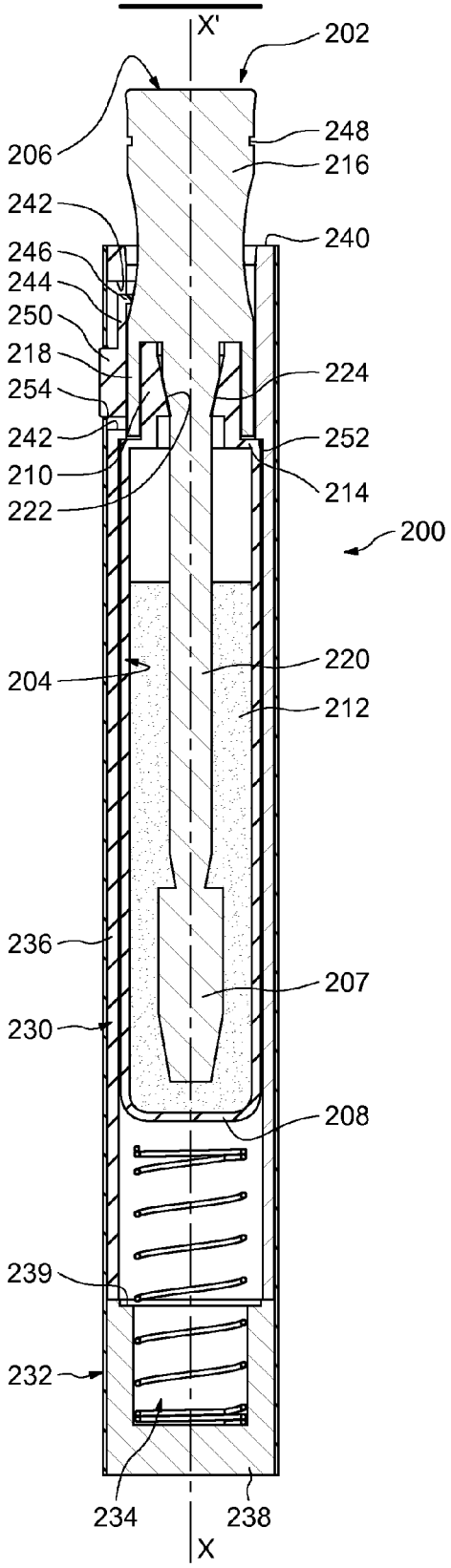
Figure 3:
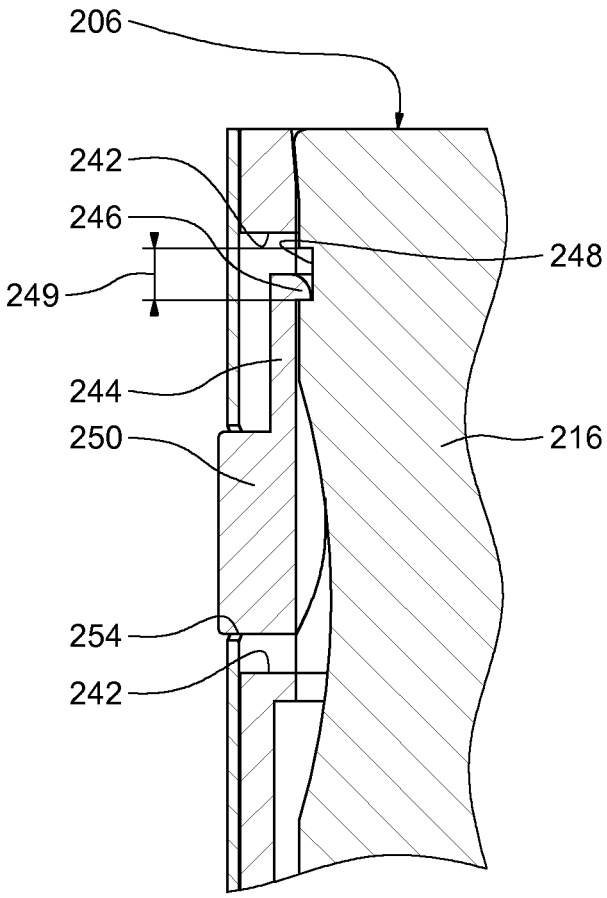
Figure 4:
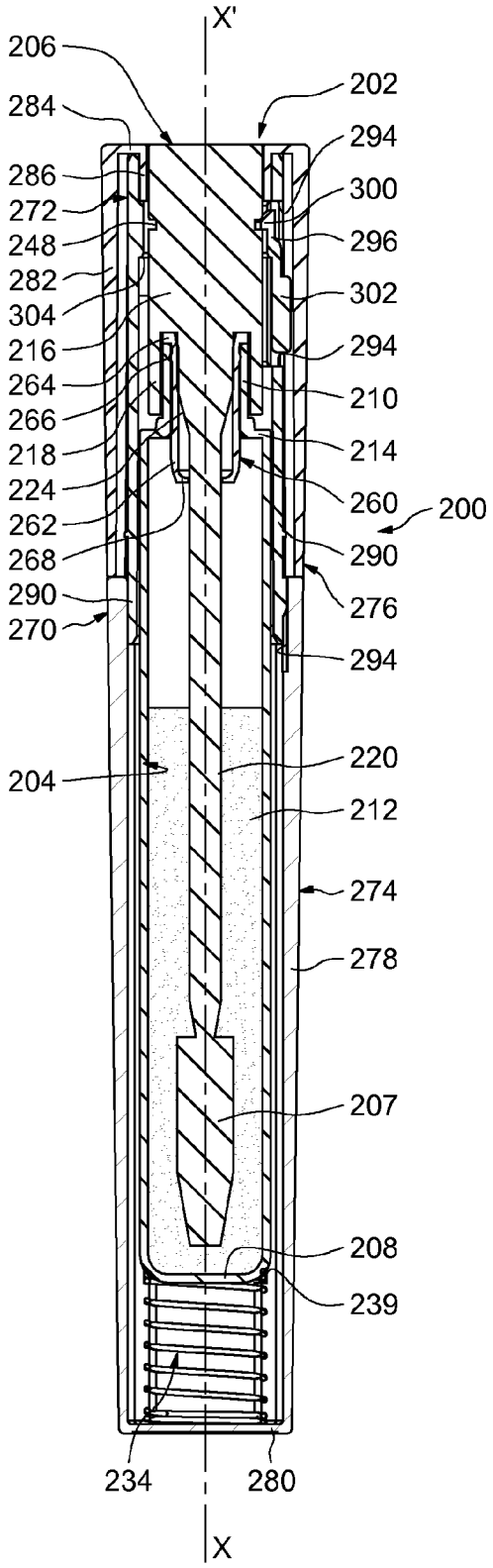
Figure 5:
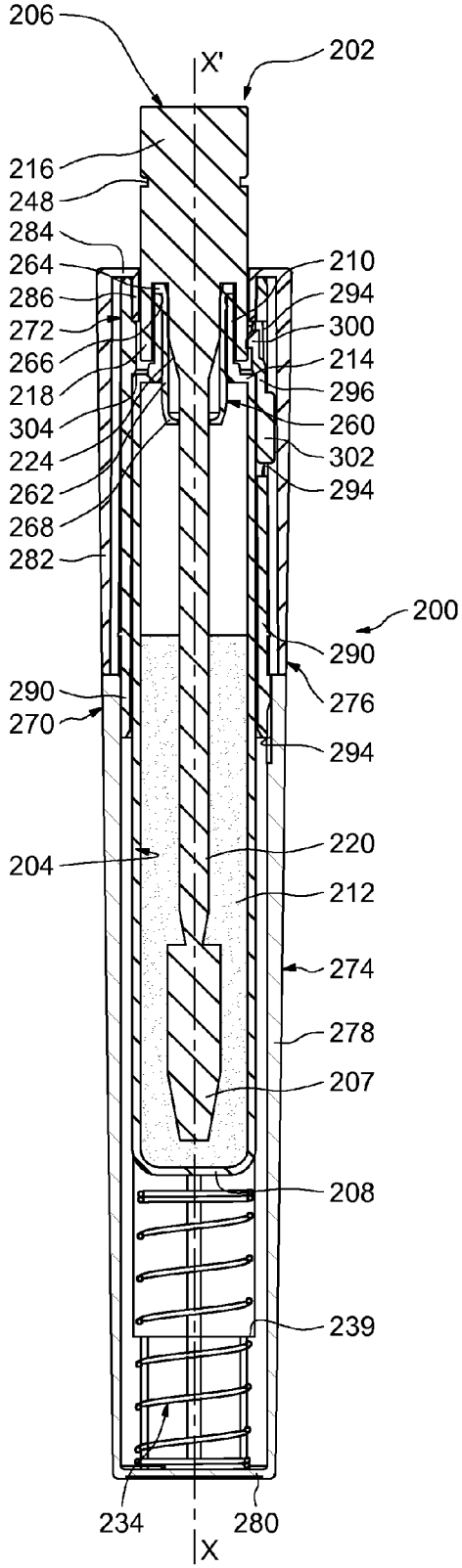
Figure 6:
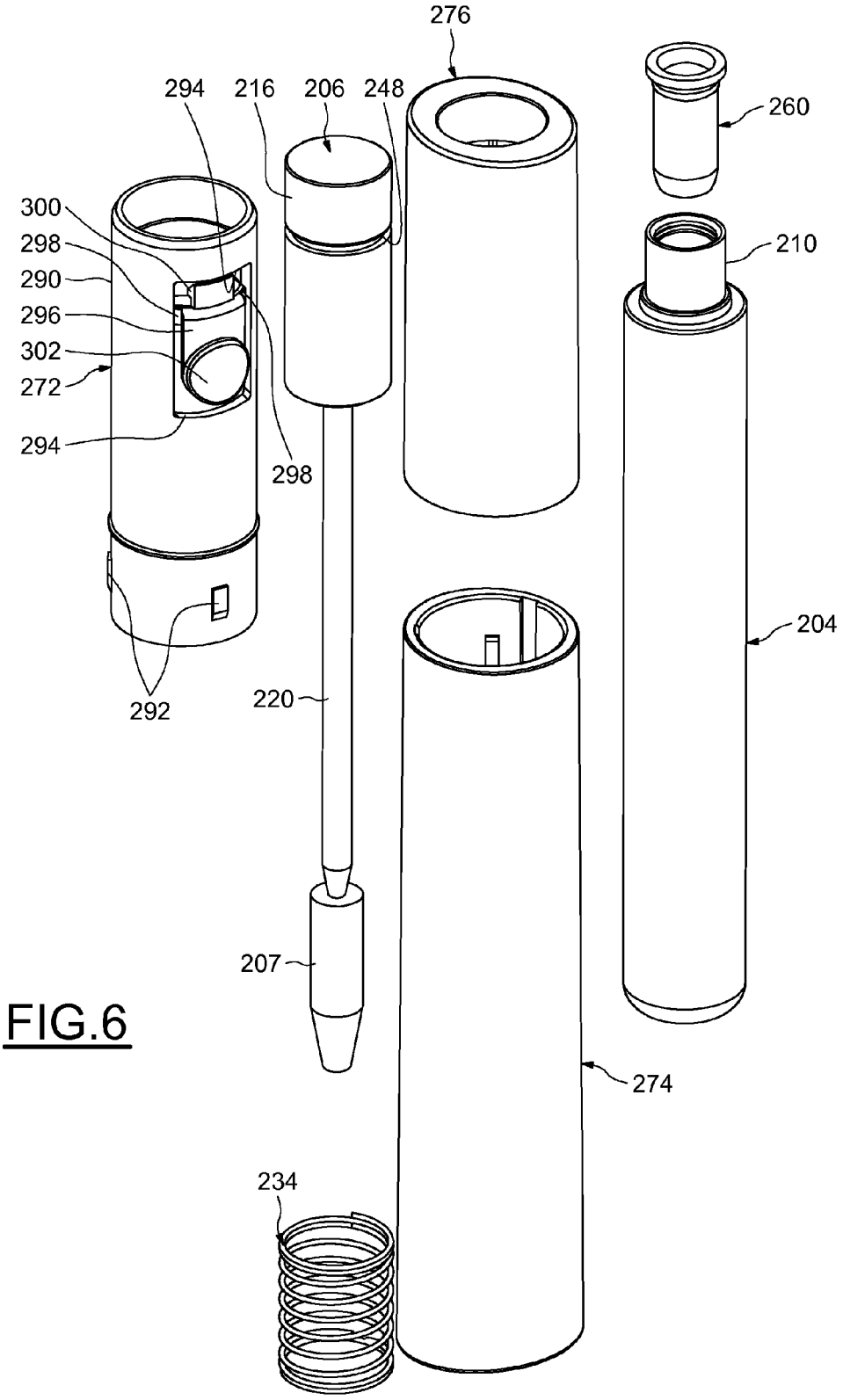
Figure 7:
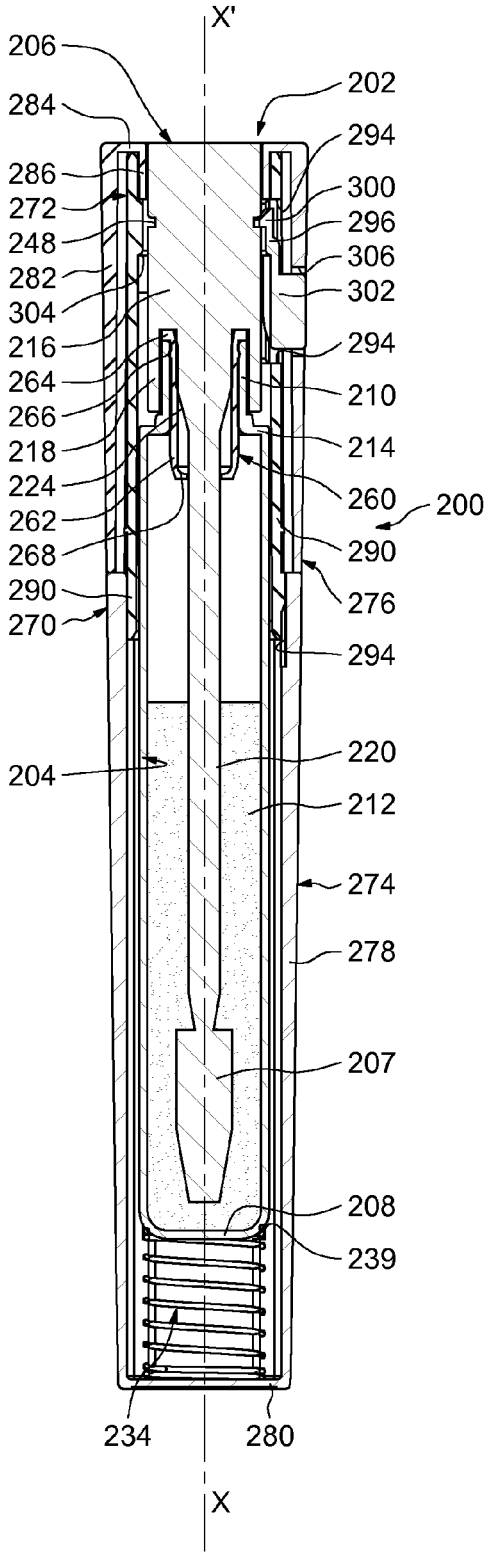
Figure 8:
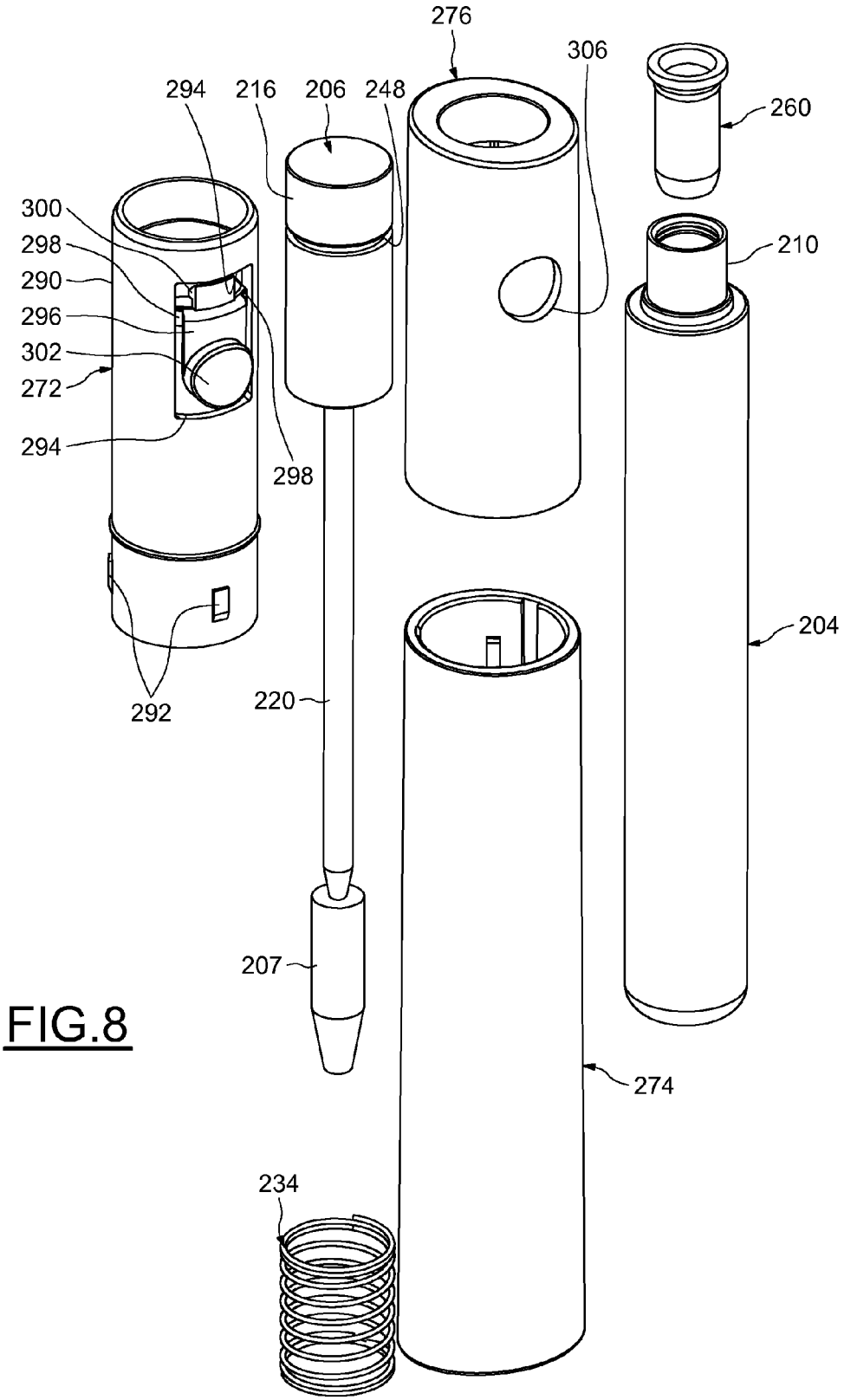
Figure 9:
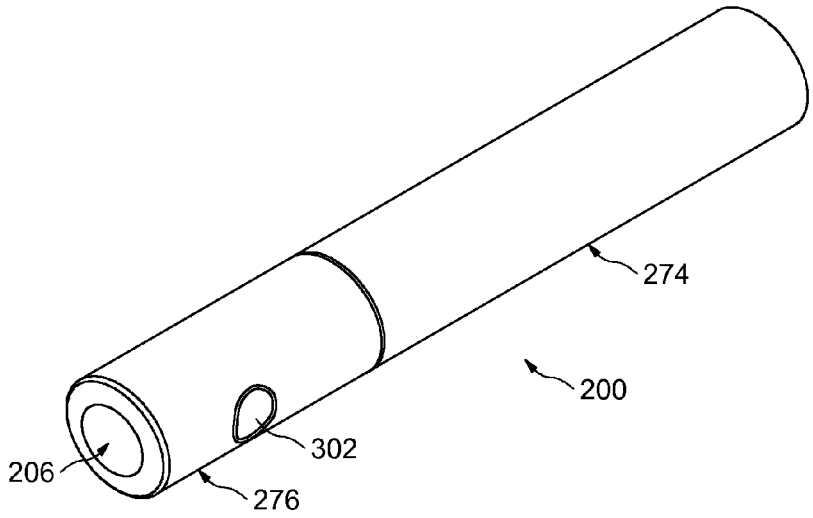
Figure 10:
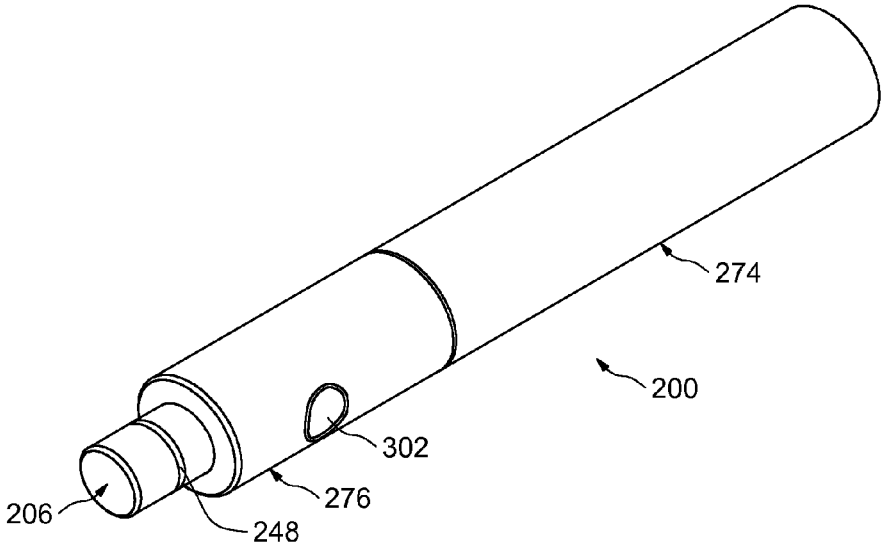
Figure 11:
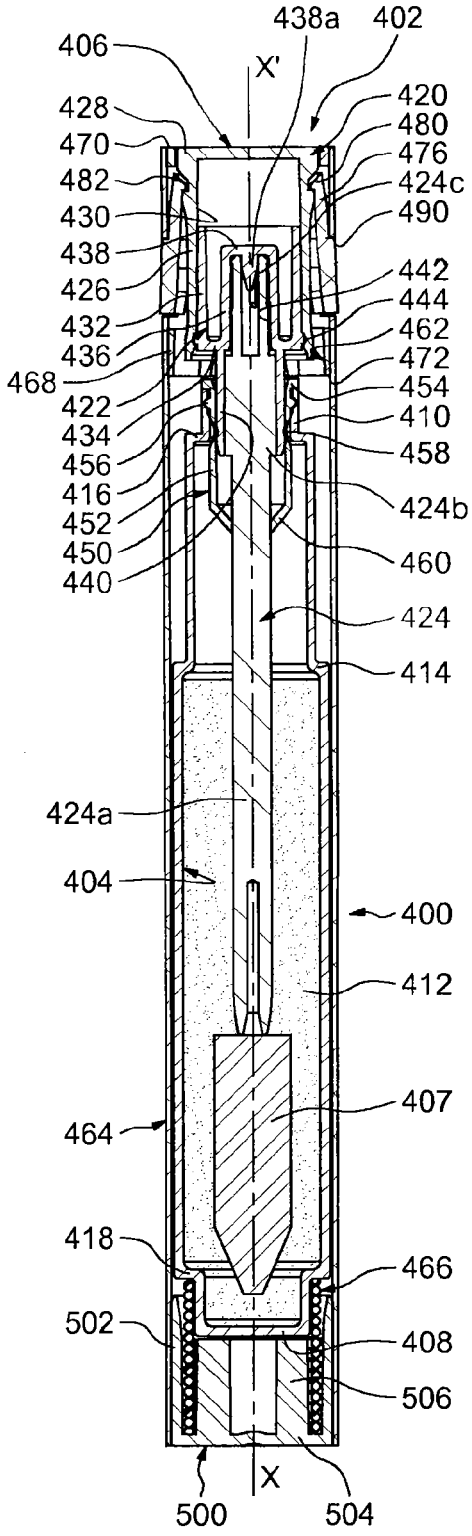
Figure 12:
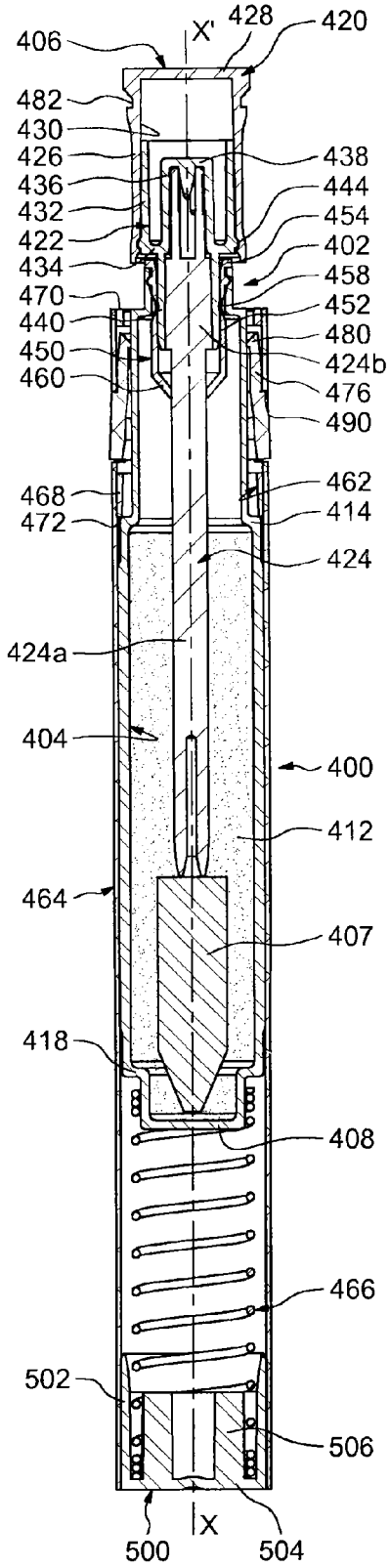
Figure 13:
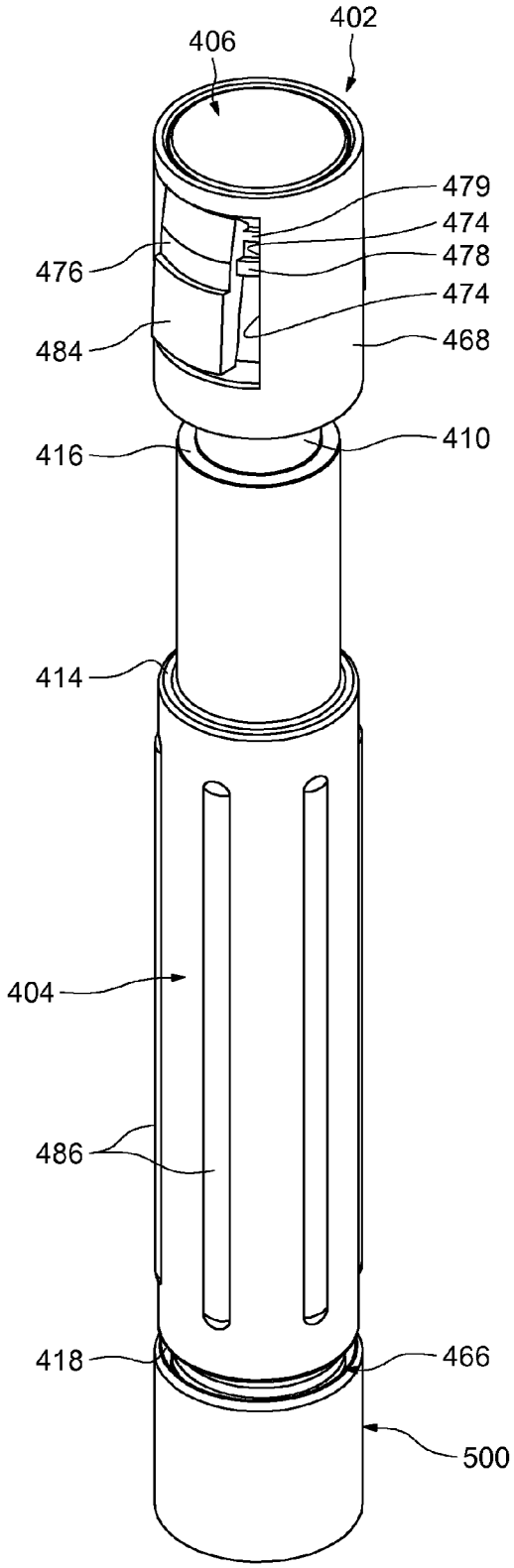

The present invention will be better understood on reading the detailed description of embodiments taken as examples that are in no way limiting and that are illustrated by the appended drawings in which:

FIGS. 1 and 2 are views in section of an assembly comprising a system for packaging and delivering a product and a device for protecting the system according to a first embodiment of the invention, FIG. 3 is a detail view of FIG. 1, FIGS. 4 and 5 are views in section of an assembly comprising a system for packaging and delivering a product and a device for protecting the system according to a second embodiment of the invention, FIG. 6 is an exploded view in perspective of the assembly of FIGS. 4 and 5, FIG. 7 is a view in section of an assembly comprising a system for packaging and delivering a product and a protective device according to a third embodiment of the invention, FIG. 8 is an exploded view in perspective of the assembly of FIG. 7, FIGS. 9 and 10 are views in perspective of the assembly of FIGS. 7 and 8, FIGS. 11 and 12 are views in section of an assembly comprising a system for packaging and delivering a product and a protective device according to a third embodiment of the invention, and FIG. 13 is a partial view in perspective of the assembly of FIGS. 11 and 12.

FIGS. 1 and 2 show a device 200 designed to be used to at least partially protect a system 202 for packaging and applying a product, particularly a cosmetic product, and for making it possible to obtain and conserve a good protection of the contained product so as to limit infiltrations into the system of air or of polluting agents that can modify the physico-chemical properties of the product. The device 200 and the system 202 are shown in these figures in a position that is assumed to be vertical.

The system 202 is designed for the packaging of a cosmetic product such as nail polish, mascara, beauty care product or gloss. It comprises a receptacle 204 for the cosmetic product and a closing member 206 which bears an applicator 207 used to apply the product contained in the receptacle.

The receptacle 204 comprises a body furnished with a closed bottom end forming a bottom 208 and furnished with an opposite open end forming a neck 210. It delimits internally a space 212 filled with the cosmetic product. Between the neck 210 and the peripheral wall of the receptacle 204, a radial shoulder 214 is arranged. The receptacle 204 extends on a vertical axis X-X' forming the longitudinal axis of the system 202. The neck 210 is centered on the axis X-X'.

The closing member 206 comprises, for its part, a closing cap 216 of generally cylindrical shape a lower radial transverse surface of which is provided to come axially in contact with the upper end of the neck 210 in order to obtain a sealed contact between the cap 216 and the neck 210 and the closure of the receptacle 204. This surface is extended axially downwards by an annular skirt 218 centered on the axis X-X'. The skirt 218 extends to the immediate vicinity of the shoulder 214 of the receptacle 204 and radially surrounds the neck 210 while coming into contact against the latter, which promotes the achievement of a good seal.

As indicated above, the closing member 206 is provided with an applicator 207. This applicator 207 is supported by a mount or stem 220 secured to the cap 216 and extending axially downwards from the lower transverse surface of the latter. The stem 220 may be molded in one piece with the cap 216 and extends on the axis X-X' when the closing member 206 is mounted on the neck 210 of the receptacle. The length of the stem 220 corresponds overall to the height of the receptacle 204 so that, when the closing member 206 is mounted on the neck 210, the applicator 207 is situated in the bottom of the receptacle.

The applicator 207 may comprise a foam, a felt, a flocked end-piece, a sintered element, a woven element, a sponge, a liner brush, a brush with or without a twisted core, a molded brush, a comb or a porous thermoplastic for allowing the application of the product contained in the receptacle 204.

As indicated above, the skirt 218 and the cap 216 of the closing member 206 press externally against the neck 210 of the receptacle 204, which allows it to be closed.

In order to promote the achievement of a good seal between the closing member 206 and the neck 210, the latter comprises internally a bore 222 of generally frustoconical shape opening out towards the inside of the receptacle 204 and designed to interact with a matching frustoconical surface 224 arranged at the root of the stem 220.

The interaction of the frustoconical surface 224 of the stem 220 and the bore 222 of the neck 210 makes it possible to promote the achievement of a good annular seal between the closing member 206 and the neck of the receptacle 204. In other words, the frustoconical surface 224 of the stem 220 closes off in a sealed manner the bore 222 of the neck 210 in order to prevent the product contained inside the receptacle 204 from flowing out. The stem 220 is in sealed engagement in the neck 210 of the receptacle. Moreover, this interaction also makes it possible to ensure by friction the relative axial holding in position of these two elements.

The protective device 200 mainly comprises a cap 230 designed to cover the packaging system 202, a cover or case 232 mounted around said cap, and return means 234 making it possible to apply an axial force to the receptacle 204 directed towards the closing member 206 for the purpose of maintaining a good seal between the latter and said receptacle. The cross section of the device 200 may be defined as a function of that of the object to be protected; it may for example be circular, elliptical, or polygonal such as square, rectangular, hexagonal, octagonal, etc.

The protective cap 230 is advantageously made in a single piece by molding of a thermoplastic, for example made of polyolefin (PO). As a variant, the protective cap 230 could be made of a metal such as steel, for example from a thin sheet rolled and bonded so as to form a cylinder.

The protective cap 230 comprises a tubular body 236, extending on the axis X-X', surrounding the peripheral wall of the receptacle 204. The body 236 comprises, at a lower axial end, a fitted end-piece forming a bottom 238 situated axially at a distance from the bottom 208 of the receptacle 204. The bottom 238 may be fitted to the body 236 by any appropriate means, for example by screwing, bonding or snap-fitting. As will be described in greater detail below, the return means 234 are placed axially between the bottom 208 of the receptacle 204 and the bottom 238 of the cap 230.

The cap 230 comprises, at an upper axial end, an upper end transverse surface 240 flush with the upper end of the closing member 206 and surrounding it radially. The system 202 is therefore entirely housed inside the protective cap 230. The protective cap 230 entirely covers the system 202 in the axial direction. In this position, no portion of the system 202 can therefore be taken hold of by the user.

The protective cap 230 comprises a means for releasing the system 202 so as to allow the user to take hold of the closing member 206 and to apply product.

In order to obtain the releasing means, the protective cap 230 comprises, arranged on the body 236 in the vicinity of its upper axial end, two generally C-shaped notches 242 delimiting an axial tongue 244 connected to said body by means of two bridges of material or opposite circumferential hinges (not visible). These hinges form a spindle for the pivoting of the tongue 244.

The tongue 244 comprises, on the inside, a radial hook 246 extending inwards and designed to interact with an annular groove 248 created on the outer surface of the cap 216 of the closing member 206, in the vicinity of its upper end.

The hook 246 and the groove 248 make it possible to hold the closing member 206, and more generally the system 202, inside the protective cap 230. The hook 246, arranged on the inner face of the tongue 244, has a diameter that is smaller than that of the cap 216 of the closing member 206 so that there is a diametral interference between these two parts, at the hook 246 and the groove 248. The hook 246 forms a means for axially holding the packaging system 202 relative to the protective cap 230 so as to form a unitary whole. In other words, the hook 246 forms means for snap-fitting the cap 230 to the closing member 206. The hook 246 is situated axially on a portion of the tongue 244 situated above the hinges allowing the articulation of the latter. As illustrated more visibly in FIG. 3, and as will be described in greater detail below, the axial dimension 249 of the groove 248 is greater than the axial dimension of the hook 246, which in particular makes it possible to compensate for the manufacturing tolerances. In the embodiment illustrated, the protective cap 230 comprises a single hook. Naturally, as a variant, it is possible to provide a larger number of hooks.

In order to allow a separation of the cap 230 and the system 202, the tongue 244 also comprises, on the outside, a radial lug 250 forming a means for actuating the hook 242. The lug 250 is arranged on the outer surface of the tongue 244 and extends radially outwards. It is situated axially on the side opposite to the hook 246 in relation to the hinges allowing the articulation of the tongue 244. The lug 250 in this instance has a generally cylindrical shape. Naturally, it can also be envisaged to provide a lug with a substantially different shape having, for example, an axi-symmetric cross section, for example polygonal.

As indicated above, the hinges of the tongue 244 form a spindle for the pivoting of the latter. The lug 250 and the hook 246 are situated axially on either side of this pivot spindle. Therefore, when a user presses on the lug 250 applying a force directed towards the inside of the cap 230, the tongue 244 pivots which has the effect of moving the hook 246 away outwards and of releasing the cap 216 of the closing member 206, and more generally the system 202. The inner face of the tongue 244 comprising the hook 246 therefore forms a surface for holding the closing member 206 and the receptacle 204 inside the protective cap 230, the opposite outer face furnished with the lug 250 comprising an actuation surface in order to cause the hook 246 to move.

In other words, the hook 246 for axially holding the closing member 206 and the receptacle 204, and the lug 250 allowing the disengagement of the hook 246 from the groove 248 form a means for releasing the system 202 relative to the protective cap 230. The hook 246, the lug 250, the tongue 244, the hinges and the body 230 are in one piece.

In this embodiment, the protective cap 230 comprises a single means for releasing the system 202 comprising the hook 246 and the lug 250. As a variant, it could be possible to provide two diametrically opposed releasing means. Therefore, to obtain the release of the system 202, it is necessary to provide pressure on both the releasing means, which limits the risk of inadvertent separation of the system 202 and the protective cap 230, for example in a handbag.

The return means 234 in particular make it easier for the system 202 to slide out of the protective cap 230 when the releasing means is actuated. They comprise a helical spring one end of which presses against the bottom 238 of the cap 230 and the other end against the bottom 208 of the receptacle 204. The spring is dimensioned so as to be constrained or compressed axially between the cap 230 and the receptacle 204 when the hook 246 is engaged with the groove 248 of the closing member 206 in order to hold the system 202 inside the device 200. The return means 234 therefore make it possible to promote and conserve a good seal for the system 202 to the extent that the force applied by these means on the bottom of the storage receptacle 204 promotes the maintenance of the annular axial contact between the neck 210 and the cap 216 of the closing member 206 and the immobilization of the neck 210 of the receptacle on the frustoconical surface 224 of the stem 220 ensuring the maintenance of the annular seal between these two elements.

In other words, maintaining the closing member 206 in a holding position inside the protective cap 230 by means of the hook 246 combined with the force applied by the return means 234 on the receptacle 204 in the direction of the closing member 206 allows the maintenance of the annular sealed contact in the axial direction of the closing member 206 against the neck 210 of the receptacle and a good annular seal between the stem 220 of the applicator and the neck 210 of the receptacle.

Once the hook 246 is moved away from the groove 248, the return means 234 make it easier to slide the system 202 out of the protective cap 230 of the device 200, and more precisely out of the cap 216 of the closing member 206.

In order to prevent the receptacle 204 being taken out of the protective cap 230, the latter comprises internally an annular radial shoulder 252 situated axially beneath the lug 250 and forming an abutment surface interacting with the shoulder 214 of the receptacle as illustrated in FIG. 2, when the closing member 206 is held by the user. Therefore, the receptacle 204 remains housed inside the protective cap 230 of the device 200; only the closing member 206 bearing the applicator 207 is protruding axially relative to the transverse surface 240 and can be separated from the receptacle 204 for the purpose of applying the product.

When the closing member 206 is taken hold of by the user and separated from the receptacle 204, the bore 222 of the neck 210 of the receptacle makes it possible to remove the surplus product that is present on the applicator 207 so that all that remains on this applicator is the correct dose to be applied. In this respect, the minimal diameter of the bore 222 is slightly smaller than the diameter of the applicator 207 so as to promote increased wringing by increasing the pressure applied by the applicator 207 on the bore 222, which is particularly useful when the surplus product is considerable. Therefore, when the applicator 207 is extracted from the receptacle 204, the applicator rubs against the bore 222 and is then wrung off. The bore 222 therefore constitutes a wringing member.

After the product has been applied, the user can reinsert the applicator 207 into the receptacle 204 and the closing member 206 into the cap 230. In order to ensure the good seal between the stem 220 of the applicator 207 and the neck 210 of the receptacle 204, the bottom 238 comprises internally a radial shoulder 239 directed axially towards the receptacle 204. When the user sinks the applicator 207 into the receptacle 204, the closing member 206 presses against the neck 210 of the receptacle and the receptacle 204 moves axially downwards inside the cap 230 until the bottom 208 presses against the shoulder 239. This ensures that the stem 220 is properly immobilized in the bore 222 of the neck of the receptacle 204 under the effect of the axial force applied by the user. When the bottom 208 of the receptacle butts against the shoulder 239, the return means 234 are constrained axially. Once the user relaxes the pressure applied to the closing member 206, the return means 234 cause an axially upward movement of the receptacle 204 and of the closing member 206. The hook 246 is then engaged with the lower surface of the groove 248 as illustrated in FIG. 3. In order to allow the movement of the closing member 206 and of the receptacle 204 until the bottom 208 butts against the shoulder 239, the axial dimension 249 of the groove 248 is greater than the axial space 251 existing between the bottom 208 and the shoulder 239 when the hook 246 is engaged with the lower surface of the groove 248. More precisely, for this purpose, the axial space separating the upper end of the hook 246 and the upper surface of the groove 248 is at least equal to the space 251.

The case 232, of generally annular shape and with an axis X-X', surrounds the protective cap 230 and comes into contact radially against the latter. The lower and upper axial ends of the case 232 are flush respectively with the lower surface of the bottom 238 and the upper transverse surface 240. The case 232 comprises a circular opening 254 designed to allow access from the outside to the lug 250 of the cap 230. The lug 250 is dimensioned so as to be at least flush with the outer surface of the case 232. The case 232 forms means for covering the cap 230 so as to limit, at the releasing means, the ingress of air or polluting agents into the latter. Except for the lug 250 and the lower and upper transverse surfaces 240, the case 232 covers the protective cap 230. As a variant, it could be possible to provide for the case 232 to cover the lower surface of the bottom 238. In another variant, it is also possible to produce the bottom 238 and the cap 230 in one piece. The case 232 may be made of metal such as steel, or be produced by molding a thermoplastic, for example a polyolefin (PO), or else be made of wood. The covering case 232 may be attached to the protective cap 230 by any appropriate means, for example by bonding, by bi-injection molding, by overmolding, etc.

In the embodiment described above, it could also be envisaged to provide a protective cap with no housing allowing the passage of the actuation lug or lugs, and comprising as a replacement on the outer surface of said cap a logo, a pictogram, or else a zone of different color from that of the rest of the cap in order to indicate to the user the zone that should be pressed in order to separate the product-packaging system and the cap.

In the embodiment illustrated in FIGS. 4 to 6, in which the elements similar to the embodiment described above bear the same references, the packaging system 202 comprises a wringing member 260 mounted in the neck 210 of the receptacle 204.

The wringing member 260 comprises an axial portion 262 mounted in a sealed manner in the neck 210 and extended, at an upper axial end, by a radial collar 264 coming into contact with the upper end of the neck 210 and the lower end of the cap 216 of the closing member 206. The axial portion 262 comprises, in the vicinity of the collar 264, a radial protrusion 266 extending outwards and interacting with a groove (not referenced) of the neck 210 in order to achieve axial holding of the wringing member 260 inside said neck. The protrusion 266, which is continuous or discontinuous in the circumferential direction, forms axial holding means of the wringing member 260 in the neck 210 of the receptacle. The root of the stem 220 is in sealed engagement inside the axial portion 262 of the wringing member 260.

The wringing member 260 comprises a radial portion 268 extending towards the inside of the lower end of the axial portion 262 and comprising an orifice (not referenced) capable of allowing the applicator 207 to pass through. This orifice has a smaller diameter than the diameter of the applicator so as to obtain increased wringing when the surplus product present on the applicator 207 is considerable.

In this embodiment, the device 200 comprises mainly a protective cap 270 made in two portions, a sheath 272 for releasing the system 202, and the return means 234 making it possible to apply an axial force to the receptacle 204.

The protective cap 270 comprises a lower portion 274 which is extended axially by an upper portion 276. The lower portion 274 comprises a body 278 extending on the axis X-X' and designed to receive the major portion of the receptacle 204. The body 278 is extended, at a lower axial end, by a bottom 280 situated axially at a distance from the bottom 208 of the receptacle 204. The return means 234 press against the bottom 208 and the bottom 280.

The upper portion 276 presses against the upper end of the body 278 of the lower portion 274 and extends axially in line with it. The upper portion 276 is attached to the lower portion 274 by any appropriate means, for example by screwing, bonding or snap-fitting.

The upper portion 276 comprises an axial portion 282 extending in line with the body 278 and delimiting internally a space for housing the upper end of the receptacle 204, the sheath 272 and the closing member 206. The axial portion 282 is extended inwards, to an upper axial end, by a radial portion 284 flush with the upper end of the closing member 206. The system 202 is entirely housed inside the protective cap 270. In this position, no portion of the system 202 can be taken hold of by the user. The radial portion 284 is extended axially, to a small-diameter edge, by a short axial skirt 286 extending towards the neck 210 of the receptacle. The skirt 286 is coaxial with the axis X-X' and allows the cap 216 of the closing member 206 to be guided inside the protective device 200.

The releasing sheath 272 comprises a tubular body 290, with an axis X-X', surrounding the upper end of the receptacle 204 and the cap 216 of the closing member 206. A lower end of the body 290 is placed radially between the receptacle 204 and the body 278 of the lower portion 274 coming into contact radially against these two elements. This lower end of the body 290 comprises radial protuberances 292 (FIG. 6) spaced apart from one another in the circumferential direction and designed to be housed inside matching grooves 294 created in the body 278 of the lower portion 274 so as to prevent a rotation of the sheath 272 relative to the protective cap 270. The upper axial end of the body 290 is placed radially between the skirt 286 and the radial portion 282 and presses axially against the radial portion 284. The sheath 272 comprises a means for releasing the system 202 of identical design to that of the embodiment described above.

In order to obtain the releasing means, the sheath 272 comprises, created on the body 290, two notches 294 that are generally C-shaped (FIG. 6) delimiting an axial tongue 296 connected to the body 290 by means of two opposite circumferential hinges 298. In a manner similar to the embodiment described above, the tongue 296 comprises, on the inside, a radial hook 300 extending inwards and designed to interact with the annular groove 248 of the cap 216 of the closing member 206 in order to hold said closing member and the packaging system 202 inside the protective device 200. The tongue 296 also comprises, on the outside, a radial lug 302 capable of forming a means for actuating the hook 300. The lug 302 is situated axially on the side opposite to the hook 300 in relation to the hinges 298.

In this embodiment, the return means 234 also have the function of helping to obtain and conserve a good seal for the system 202 because the force applied by these means on the receptacle 204 helps to maintain the annular axial contact between the collar 264 of the wringing member 260 and the cap 216 of the closing member 206, which prevents the product contained in the receptacle 204 from flowing out. The sealed contact between the closing member 206 and the neck 210 of the receptacle is therefore obtained by means of the collar 264 of the wringing member. Moreover, the annular seal between the root of the stem 230 and the bore of the axial portion 262 of said member also helps to prevent the product from flowing out of the receptacle 204.

Advantageously, the upper portion 276 of the protective cap 270 comprises, on its outer surface, a logo, a pictogram, or else a zone of a different color from that of the rest of the cap so as to indicate to the user the zone that should be pressed to apply a force on the lug 302 and separate the packaging system 202 from the protective device 200. For this purpose, the cap 270 is made of a material having sufficient elasticity to allow sufficient deformation for the purpose of the actuation of the lug 302.

To achieve this separation, the user can alternatively press on the upper surface of the closing member 206, which also allows the movement of the hook 300 and the release of the closing member 206 and of the applicator 207.

In order to prevent the receptacle 204 being extracted from the protective cap 270 during this operation, the sheath 272 comprises internally a radial shoulder 304 situated axially between the lug 302 and the hook 300 and forming an abutment surface interacting with the shoulder 214 of the receptacle 204 as illustrated in FIG. 5, when the closing member 206 is grasped by the user. Therefore, the receptacle 204 remains housed inside the protective cap 270 when the closing member 206 is separated from the receptacle 204 and the cap 270 for the purpose of applying the product.

The embodiment illustrated in FIGS. 7 to 10, in which identical elements bear the same reference numbers, differs from the embodiment previously described only in that the lug 302 has a larger radial dimension so as to be able to extend through a circular opening 306 created on the upper portion 276 of the protective cap 270 so that the lug 302 is directly accessible from the outside.

FIGS. 11 to 13 represent a device 400 designed to be used to protect a system 402 for packaging and applying a cosmetic product such as nail polish, mascara, beauty care product or gloss.

The system 402 mainly comprises a receptacle 404 for the cosmetic product and a closing member 406 supporting an applicator 407 used to apply the product contained in the receptacle.

The receptacle 404 comprises a body furnished with a closed lower end forming a bottom 408 and with an opposite open end forming a neck 410. It delimits internally a space 412 filled with the cosmetic product. The peripheral wall of the receptacle 404 has a tiered shape and comprises substantially half-way up a radial shoulder 414 that can axially delimit the space 412 filled with cosmetic product. Between the neck 410 and the peripheral wall of the receptacle, a radial shoulder 416 is arranged extending inwards. Between the bottom 408 and said peripheral wall a radial shoulder 418 is also arranged extending inwards. The receptacle 404 extends on a vertical axis X-X' forming the longitudinal axis of the system 402.

The closing member 406 comprises a closing cap 420, a stem holder 422 mounted partially inside said cap and a mount or stem 424 supported by the stem holder and bearing the applicator 407.

The closing cap 420 comprises a tubular body 426 centered on the axis X-X' which is closed at an upper end by a radial portion 428. In the mounted position of the closing member 406 on the receptacle 404, the lower end of the body 426 remains axially set back from the upper end of the neck 410 of said receptacle. The body 426 and the radial portion 428 delimit internally a housing 430 centered on the axis X-X', open towards the receptacle 404 and into which the stem holder 422 is partly inserted. The closing cap 420 is advantageously made in a single piece by molding of a thermoplastic, for example polyolefin (PO).

The stem holder 422 comprises a body 432 of annular shape extending on the axis X-X' and prolonged at a lower end to the inside via an annular radial wall 434, itself prolonged at a small-diameter edge by an annular axial skirt 436 centered on the axis X-X' and extending towards the upper end of the body 432 while remaining axially set back from the latter. The upper end of the skirt 436 is closed by a radial wall 438.

The stem holder 422 also comprises an annular axial portion 440 centered on the axis X-X' and extending from the radial wall 434 axially on the side opposite to the skirt 436. The axial portion 440, the skirt 436 and the radial wall 438 delimit a tiered axial space 442 in which the upper end of the stem 424 is mounted. The body 432, the skirt 436 and the radial walls 434, 438 are situated axially inside the housing 430 created by the closing cap 420. The axial portion 440 extends axially in protrusion from said housing and is mounted inside the neck 410 of the receptacle 404. The body 432 comes radially into contact in the bore of the body 426 of said closing cap.

To obtain an axial hold of the stem holder 422 relative to the closing cap 420, the body 432 comprises on its outer surface, in this instance axially in the vicinity of its lower end, a radial protrusion 444 extending outwards and interacting with a groove (not referenced) created in the bore of the body 426 of the closing cap. The protrusion 444, which is continuous or discontinuous in the circumferential direction, forms a means for axially holding the stem holder 422 relative to the closing cap 420. The stem holder 422 is advantageously made in a single piece by molding of a thermoplastic, for example a polyolefin (PO).

The stem 424 of the closing member 406 extends on the axis X-X' when the stem holder 422 is inserted into the neck 410 of the receptacle. The length of the stem 424 is adapted to the height of the receptacle 404 so that, when the axial portion 440 of the stem holder 422 is inserted into the neck 410, the applicator 407 is situated in the vicinity of the bottom 408.

The stem 424 comprises a cylindrical portion 424*a* at the lower end of which is mounted the applicator 407 and a cylindrical mounting portion 424*b* extending the upper end of said cylindrical portion and sealingly engaged inside the axial portion 440 of the stem holder 422. The stem 424 also comprises an annular post 424*c* axially extending the upper end of the mounting portion 424*b* and being housed in the skirt 436 of the stem holder. The post 424*c* presses axially against the radial wall 438 of the stem holder.

The post 424*c* comprises, on its outer surface, at its upper end, a radial protrusion (not referenced) extending outwards and interacting with a groove created in the bore of the skirt 436 of the stem holder 422 in order to obtain an axial hold of the stem 424 relative to said stem holder. In order to ensure a good centering of the stem 424 inside the skirt 436, the radial wall 438 of the stem holder comprises a centering pin 438*a* mounted in the recess of the annular post 424*c*. The stem 424 is advantageously made in a single piece by molding of a thermoplastic, for example polyolefin (PO).

The packaging system 402 also comprises a wringing member 450 mounted in the neck 410 of the receptacle 404. It comprises an annular axial portion 452 mounted in a sealed manner in the neck 410 and extended, at an upper axial end, by a radial collar 454 pressing against the upper end of the neck 410. The axial portion 452 comprises, on its outer surface, in the vicinity of the collar 454, a radial protrusion 456 extending outwards and interacting with a groove (not referenced) created in the bore of the neck 410 in order to obtain an axial hold of the wringing member 450 inside said neck. The protrusion 456, which is continuous or discontinuous in the circumferential direction, therefore forms a means of axially holding the wringing member 450 on the receptacle 404.

The axial portion 440 of the stem holder 422 is in sealed engagement inside the bore of the axial portion 452 of the wringing member 450. In order to ensure a particularly satisfactory seal between these two elements, the axial portion 452 of the wringing member 450 comprises, on its outer surface, axially beneath the protrusion 456, a radial annular deformation 458 extending inwards and forming an annular rib or flute having an inner diameter slightly smaller than the outer diameter of the axial portion 440 of the stem holder 422. The deformation 458 comes radially into contact against the outer surface of the axial portion 440.

The interaction of the deformation 458 of the wringing member and of the axial portion 440 of the stem holder 422 makes it possible to obtain a good radial annular seal in this zone, and more generally between the closing member 406 and the neck of the receptacle 404. In other words, the axial portion 452 of the wringing member 450 is closed off in a sealed manner by diametral interference between the deformation 458 and the axial portion 440 of the stem holder in order to prevent the product contained in the receptacle 404 from flowing out.

The wringing member 450 also comprises a frustoconical portion 460 extending inwards the lower end of the axial portion 452 and comprising an orifice capable of allowing the applicator 407 to pass through. This orifice has a diameter smaller than the diameter of the applicator 407 so as to provide an increased wringing action when the surplus product present on the applicator is considerable. The orifice of the frustoconical portion 460 is, in this instance, provided also to allow a wringing of the cylindrical portion 424*a* of the stem 424 when the closing member 406 is withdrawn from the receptacle 404.

The protective device 400 comprises a cap 462 mounted on the packaging system 402, a cover or case 464 mounted around said cap and return means 466 making it possible to apply an axial force to the receptacle 404 directed towards the closing member 406. The cross section of the device 400 may be defined as a function of that of the system to be protected. It may, for example, be circular, elliptical, or polygonal such as square, rectangular, hexagonal, octagonal, etc.

The cap 462 is advantageously made in a single piece by molding of a thermoplastic, for example polyolefin (PO). As a variant, the cap 462 could be made of a metal such as steel, for example from a thin sheet rolled and bonded so as to form a cylinder.

The cap 462 comprises a tubular body 468 extending on the axis X-X', surrounding the cap 420 of the closing member and pressing radially against the latter. The body 468 comprises an upper end transverse surface 470 flush with the radial portion 428 of the closing cap 420 and surrounding it radially.

The body 468 also comprises a lower end transverse surface 472 situated axially between the collar 454 of the wringing member 450 and the lower end of the body 426 of the closing cap 420.

The cap 462 comprises two means to make it possible to release the system 402 so as to be able to take hold of the closing member 406 for the purpose of applying the cosmetic product.

To obtain one of its releasing means, the cap 462 comprises, arranged on the body 468 in the vicinity of its upper axial end, two notches 474 (FIG. 13) that are generally C-shaped delimiting an axial tongue 476 connected to said body by means of two bridges of material or opposite circumferential hinges 478. These hinges 478 form a spindle for the pivoting of the tongue 476.

The tongue 476 comprises, on the inner side, a radial hook 480 extending inwards and designed to interact with an annular groove 482 arranged on the outer surface of the body 426 of the closure cap 420, in the vicinity of its upper end.

The hook 480 and the groove 482 make it possible to hold the closing member 406 and more generally the system 402 inside the cap 462. The hook 480, arranged on the inner face of the tongue 476, has a smaller diameter than that of the body 426 so that there is a diametral interference between these two parts, at the hook 480 and the groove 482. The hook 480 forms a means for axially holding the system 402 relative to the cap 462 so as to form a unitary assembly. In other words, the hook 480 forms means for snap-fitting the cap 462 onto the closing member 406. The hook 480 is placed axially on a portion of the tongue 476 situated above the hinges 478 allowing its articulation. Circumferentially opposite hinges 479 are also provided between the tongue 476 and the lateral edges of the notches 474. The hinges 474 are provided in the vicinity of the upper end of the tongue 476, i.e. axially above the hinges 478.

To allow a separation of the cap 462 and of the system 402, the tongue 476 comprises, on the outside, a radial lug 484 forming a means for actuating the hook 480. The lug 484 is arranged on the outer surface of the tongue 476 and extends radially outwards. It is situated axially on the side opposite to the hook 480 in relation to the hinges 478. The lug 484 in this instance has a generally rectangular shape. Naturally, it can also be envisaged to provide a lug with a substantially different shape, for example cylindrical.

As indicated above, the hinges 478 of the tongue 476 form a spindle for the pivoting of the latter. The lug 484 and the hook 480 are situated axially on either side of this pivot spindle.

Therefore, when a user presses on the lug 484 by applying a force directed towards the inside of the cap 462, the tongue pivots, which has the effect of moving the hook 480 away towards the outside and of releasing the closing cap 420, and more generally the system 402. The inner face of the tongue 476 comprising the hook 480 therefore forms a surface for holding the closing member 406 and the receptacle 404, the opposite outer face furnished with the lug 484 comprising an actuation surface for moving the hook. The axial holding hook 480 and the lug 484 allowing the disengagement of said hook from the groove 482 form the first means for releasing the system 402 relative to the cap 462. As indicated above, in the illustrated embodiment, two releasing means are provided on the cap 462. The second releasing means is diametrically opposed to the first means and identical. As a variant, it could be possible to provide a single releasing means.

The case 464, of generally annular shape and with an axis X-X', surrounds the cap 462 and comes into contact radially against the latter. It comprises two rectangular openings 490 that are diametrically opposed and provided to allow access from the outside to the actuation lugs 484 that are dimensioned so as to at least be flush with the outer surface of the case. The case 464 forms means for covering the cap 462 so as to limit, at the releasing means, the ingress of air or polluting agents into the latter.

The upper axial end of the case 464 is flush with the upper transverse surface 470 of the cap 462, the lower axial end of said case being offset axially downwards relative to the bottom 408 of the receptacle 404. The case 464 may be made of metal such as steel, or be obtained by molding a thermoplastic, for example a polyolefin (PO), or else wood. The covering case 464 may be attached to the cap 462 by any appropriate means, for example by bonding, by bi-injection molding, by overmolding, etc.

The device 400 also comprises an end-piece 500 attached to the lower end of the case 464 by any appropriate means, for example by bonding, snap-fitting, screwing, etc. The end-piece 500 may advantageously be made in a single piece by molding a thermoplastic, for example a polyolefin (PO). The end-piece 500 forms a bottom of the case 464. The end-piece 500 comprises an annular body 502 provided with a radial bottom wall 504 flush with the lower axial end of the case 464. The end-piece 500 comprises an annular post 506 extending from the bottom wall 504 towards the bottom 408 of the receptacle 404 and being able advantageously to form a bearing surface for said bottom. A radial annular space is formed between the body 502 and the post 504 allowing the return means 466 to be mounted.

The return means 466 are notably provided to make it easier to slide the system 402 out of the cap 462 when the releasing means are actuated. The return means 466 comprise a helical spring one end of which presses against the bottom wall 504 and the other end against the shoulder 418 of the bottom 408 of the receptacle 404. The spring is dimensioned so as to be stressed or compressed axially between the end-piece 500 and the receptacle 404 when the hooks 480 of the cap 468 are engaged with the groove 482 of the closing member 406 in order to hold the system 402 inside the device 400.

Once the hooks 480 are moved away from the groove 482, the return means 466 make it easier to axially slide the cap 420 of the closing member 406 out of the cap 462 of the device 400.

When the cap 420 is slid out of the cap 462, the shoulder 414 of the receptacle makes it possible to prevent it coming out of the cap. Specifically, the shoulder 414 butts against the lower end 472 of the cap 462 as illustrated in FIG. 12. Therefore, the receptacle 404 remains housed inside the case 464 and the cap 462, only the closing member 406 supporting the applicator protruding axially relative to the transverse surface 470 of the cap 462. In order to limit the friction between the bore of the case 464 and the receptacle 404 when said receptacle is moved under the effect of the return means 466, the latter comprises, on its outer surface, longitudinal side members 486 (FIG. 13) extending axially between the shoulders 414, 418. The side members have, in cross section, a generally convex shape and are positioned evenly in the circumferential direction over the outer surface of the receptacle 404. In this instance they are six in number.

After pressing the releasing means, the user can separate the closing member 406 from the receptacle 404 for the purpose of applying the product.

After application, when the user inserts the applicator 407 into the receptacle 404, the axial portion 440 of the stem holder 422 is inserted into the bore of the axial portion 452 of the wringing member 450, which makes it possible to obtain the annular seal between the deformation 458 of said wringing member and the outer surface of the axial portion 440, and the receptacle 404 moves axially downwards inside the case 462 until the shoulder 418 presses against the upper end of the end-piece 500. In this position, the return means 466 are stressed axially. Once the user relaxes the pressure applied to the closing member 406, the return means 466 cause a movement of the receptacle 404 upwards in the direction of the closing member 406.

The hooks 480 are then engaged with the lower surface of the groove 482 created in the closing cap 420. In order to allow the movement of the closing member 406 and of the receptacle 404 until the shoulder 418 butts against the upper end of the end-piece 500, the axial dimension of the groove 482 is greater than the axial space existing between said shoulder 418 and the upper end of the end-piece when the hooks 480 are engaged with the lower surface of the groove 482. More precisely, for this purpose, the axial space separating the upper end of the hooks 480 and the upper surface of the groove 482 is at least equal to this axial space existing between the shoulder 418 and the upper end of the end-piece 500.

The force applied by the return means 466 on the shoulder 418 makes it possible to ensure a good seal between the stem holder 422 and the wringing member 250. Specifically, the force applied by the return means 466 causes the upward axial movement of the receptacle 404 and of said wringing member, which makes it possible to ensure that the radial deformation 458 of the wringing member interacts with the axial portion 440 of the stem holder 422 so as to ensure a good annular seal between these two elements.

In the embodiments illustrated in FIGS. 1 to 10, the return means promote the maintenance of the annular axial contact between the neck of the storage receptacle and the closing member in order to obtain a sealed contact between these two elements. In the embodiment illustrated in FIGS. 11 to 13, the return means promote the maintenance of the annular radial contact between the wringing member fitted to the neck of the receptacle and the stem holder of the closing member so as also to ensure a sealed contact between these two elements. "Sealed contact" means the seal that satisfies the two inspection methods that will be described.

A first method makes it possible to test the seal of the assembly comprising the packaging system and the protective device with respect to the weight of composition or of cosmetic product inserted into the storage receptacle of the system. This method consists in calculating the loss of weight of the elements forming the assembly after a period of 7 days in an oven at 45° C.

First, the weight is taken individually of several assemblies comprising the protective device and the packaging system with a storage reservoir that is empty, i.e. not filled with cosmetic product. These assemblies form control samples. It is possible, for example, to weigh five assemblies. Their results are marked mi.

Also weighed individually is a plurality of assemblies to be tested with an empty storage reservoir, for example eight assemblies, so as to obtain the individual tare of each assembly. This tare is marked Ti.

Then, the cosmetic product is inserted into the storage receptacle of each of these assemblies to be tested and they are weighed individually. The reference Mi is associated with this weight. Then the difference in weight of packaged product is determined, which is equal to Mi−Ti.

Then, the assemblies to be tested and the assemblies forming control samples are placed in an oven and the temperature is raised to 45° C.±1° C. After 7 days, all of the assemblies are taken out and left to return to ambient temperature before each of these assemblies is weighed in order to determine their final weight.

For the assemblies forming control samples, the average weight difference is calculated between the initial weight mi and the final weight mf which is equal to $$\sum\left(\frac{mi-mf}{5}\right).$$

This gives the average change in weight of the various elements constituting the assemblies forming samples.

For each of the assemblies to be tested, the final weight Mf is determined and then the following formula is applied to determine the weight loss:

$$\Delta P = \frac{(Mi-Mf)-\sum\frac{(mi-mf)}{5}}{Mi-Ti}\times 100$$

It is considered that the tested assembly is leak-proof when the weight loss ΔP found after 7 days in the oven is less than 0.25%.

The second inspection method is as follows. It consists in verifying the seal of the assembly comprising the protective device and the packaging system with a storage reservoir that is empty, i.e. not filled with cosmetic product.

According to this second method, a first inspection consists in running a test in a vacuum enclosure of the assembly to be tested. First, water colored with methylene blue is placed in the storage receptacle of the assembly to be tested up to the nominal filling level. The closing member is then mounted on the neck of the receptacle and the assembly is placed so that the closing member points downwards onto white absorbent paper inside the vacuum enclosure. The pressure inside the enclosure is then raised to a value of between 200 and 250 millibars for 5 minutes.

The tested assembly is considered not to conform if a leak is observed on the absorbent paper, or if, after the closing member has been taken off, colored water is present at the neck of the receptacle.

The second inspection consists in inserting water colored with methylene blue into the assembly to be tested to the nominal filling level, then in placing the assembly with the closing member pointing downwards on absorbent paper for 24 hours±1 hour and placing this assembly in an oven at 45° C.±2° C.

Like the first inspection, the assembly is considered not to conform if a leak is observed on the absorbent paper or, if after the closing member has been taken off, colored water is present at the neck of the receptacle.

The invention claimed is:

1. An assembly, comprising:

a system for the packaging and application of a product;

a return means capable of applying an axial force to the packaging and application system; and a device for protecting said system;

wherein the system comprises:

a receptacle for storing the product;

a product applicator capable of being inserted into the receptacle in order to be loaded with the product to be applied; and a member for closing the receptacle bearing the applicator; and the protective device comprises:

a cap mounted on the packaging and application system so as to at least partly cover it; and at least one means for releasing said system, the releasing means comprising:

a means for holding the system relative to the device; and a means for actuating the holding means in order to render the holding means inactive and at least partly separate the system and the protective device, wherein the holding means is provided on an inner face of the releasing means and the actuation means is provided on an outer face of the releasing means opposite to the inner face, and wherein the return means capable of applying an axial force to the packaging and application system maintains a sealed contact between the closing member and the storage receptacle in an active position of the holding means.

2. The assembly as claimed in claim 1, wherein a neck of the storage receptacle is held axially pressing against the closing member by the force applied by the return means in the active position of the holding means.

3. The assembly as claimed in claim 1, wherein the closing member comprises a stem bearing the applicator, the stem comprising a frustoconical surface sealingly engaged in a bore of a neck of the storage receptacle.

4. The assembly as claimed in claim 3, wherein the closing member further comprises a skirt radially surrounding and contacting against a neck of the storage receptacle.

5. The assembly as claimed in claim 1, wherein the packaging system further comprises a wringing member mounted in a sealed manner in a neck of the storage receptacle.

6. The assembly as claimed in claim 5, wherein the wringing member comprises means extending towards the inside and coming radially into sealed contact against the closing member.

7. The assembly as claimed in claim 6, wherein the contact between the extending means and the closing member is maintained by the force applied by the return means in the active position of the holding means.

8. The assembly as claimed in claim 1, wherein the closing member further comprises a closing cap, a stem holder mounted at least partly inside the closing cap and a stem supported by said stem holder and supporting the applicator.

9. The assembly as claimed in claim 8, wherein the cap comprises internally an abutment for the storage receptacle so as to hold said receptacle inside the cap, during a pressure from the actuation means, wherein only the closing member protrudes axially relative to the cap under an effect of the return means.

10. The assembly as claimed in claim 1, wherein the holding means comprises snap-fitting means interacting with the closing member.

11. The assembly as claimed in claim 10, wherein the snap-fitting means comprise at least one hook interacting with a groove created on the closing member.

12. The assembly as claimed in claim 1, wherein the return means are placed axially between a bottom of the storage receptacle and a bottom of the protective device.

13. The assembly as claimed claim 1, wherein the releasing means comprises at least one pivot spindle situated between the holding means and the actuation means, said means being situated on either side of said spindle.

14. The assembly as claimed in claim 1, wherein the protective device comprises a covering case mounted around the cap.

15. The assembly as claimed in claim 6, wherein the closing member further comprises a closing cap, a stem holder mounted at least partly inside the closing cap and a stem supported by said stem holder and supporting the applicator.

16. The assembly as claimed in claim 7, wherein the closing member further comprises a closing cap, a stem holder mounted at least partly inside the closing cap and a stem supported by said stem holder and supporting the applicator.

17. The assembly as claimed in claim 11, wherein the groove on the closing member has a circular cross section.

* * * * *